US011465312B1

(12) United States Patent
Wang

(10) Patent No.: US 11,465,312 B1
(45) Date of Patent: Oct. 11, 2022

(54) CODED PUSH BLOCK

(71) Applicant: Henry Wang, Winter Springs, FL (US)

(72) Inventor: Henry Wang, Winter Springs, FL (US)

( * ) Notice: Subject to any disclaimer, the term of this patent is extended or adjusted under 35 U.S.C. 154(b) by 0 days.

(21) Appl. No.: 17/716,750

(22) Filed: Apr. 8, 2022

(51) Int. Cl.
*B27B 25/10* (2006.01)

(52) U.S. Cl.
CPC ..... *B27B 25/10* (2013.01)

(58) Field of Classification Search
CPC ..... B27C 5/06; B27B 25/10; Y10T 83/6638; Y10T 83/727; Y10T 83/773
See application file for complete search history.

(56) References Cited

U.S. PATENT DOCUMENTS

| | | | |
|---|---|---|---|
| 751,121 | A | 2/1904 | Tidey |
| 1,032,278 | A | 7/1912 | England |
| 1,710,718 | A | 4/1929 | Stotz |
| 2,134,606 | A | 10/1938 | Hackworth et al. |
| 2,410,467 | A | 11/1946 | Valentine |
| 2,522,965 | A | 9/1950 | Schaufelberger |
| 2,620,929 | A | 12/1952 | Sportsman |
| 2,754,857 | A | 7/1956 | Joslin |
| 2,839,100 | A | 6/1958 | Valicenti |
| 2,895,513 | A | 7/1959 | Cowley |
| 2,929,419 | A | 3/1960 | Johnson |
| 3,934,341 | A | 1/1976 | Carlson |
| 4,001,903 | A | 1/1977 | Hay |
| 4,066,250 | A | 1/1978 | Campbell |
| D248,144 | S | 6/1978 | Kreitz |
| 4,348,925 | A | 9/1982 | Manweiler |
| 4,370,909 | A | 2/1983 | Jennings |
| 4,432,263 | A | 2/1984 | Kowalchuk |
| 4,476,757 | A | 10/1984 | Morris |
| 4,485,711 | A | 12/1984 | Schnell |
| D278,022 | S | 3/1985 | Ash |
| D278,790 | S | 5/1985 | Chaney et al. |
| 4,603,612 | A | 8/1986 | Atkins |
| 5,016,509 | A | 5/1991 | Stottman |
| 5,140,778 | A | 8/1992 | Carruth |
| D342,658 | S | 12/1993 | Gakhar et al. |
| 5,330,167 | A | 7/1994 | Plumb |
| 5,341,711 | A | 8/1994 | Stay, Jr. et al. |
| 5,662,019 | A | 9/1997 | Denman |
| 5,678,467 | A | 10/1997 | Aigner |
| 5,875,827 | A | 3/1999 | Brutscher et al. |
| 5,894,777 | A | 4/1999 | Sterling |

(Continued)

*Primary Examiner* — Jennifer S Matthews
(74) *Attorney, Agent, or Firm* — Wolter Van Dyke Davis, PLLC; Robert L. Wolter

(57) ABSTRACT

An apparatus (100), including: a push block (100) including: a first side (120) and a second side (122), each configured to abut and slide along a fence of the table saw; and a bottom (124) including a first tunnel (130) and a second tunnel (132) and an immovable dividing wall (134) therebetween. When the first side abuts the fence the first tunnel is configured to straddle a blade throughout a first tunnel first range of fence positions (R12), and the second tunnel is configured to straddle the blade throughout a second tunnel first range of fence positions (R34). When the second side abuts the fence the first tunnel is configured to straddle the blade throughout a first tunnel second range of fence positions (R45), and the second tunnel is configured to straddle the blade throughout a second tunnel second range of fence positions (R23).

23 Claims, 8 Drawing Sheets

(56) References Cited

U.S. PATENT DOCUMENTS

| | | | | |
|---|---|---|---|---|
| 6,044,740 | A | 4/2000 | Werkheiser | |
| 6,098,972 | A | 8/2000 | Klimach et al. | |
| 6,135,521 | A | 10/2000 | Wirth, Jr. et al. | |
| 6,164,176 | A | 12/2000 | Larsson | |
| 6,196,283 | B1 | 3/2001 | Hundegger | |
| 6,382,608 | B1 | 5/2002 | Michell | |
| 6,491,073 | B1 | 12/2002 | Essick | |
| 6,732,623 | B1 | 5/2004 | Jennings | |
| 7,040,206 | B2 | 5/2006 | Wang | |
| 7,540,224 | B2 | 6/2009 | Wang | |
| 2005/0092152 | A1* | 5/2005 | Wirth, Jr. | B27B 25/10 83/436.2 |
| 2011/0259315 | A1* | 10/2011 | Brown | B27C 9/005 83/522.11 |
| 2021/0138682 | A1* | 5/2021 | Fife | B27B 25/10 |

* cited by examiner

CODED PUSH BLOCK

FIELD OF THE INVENTION

The invention relates generally to the field of woodworking tools, and more particularly to the field of accessories for safely feeding stock across a saw table.

BACKGROUND OF THE INVENTION

A table saw typically includes a flat, horizontally oriented table having an opening formed therein through which a top portion of a circular saw blade protrudes. The saw blade may be 10-12 inches in diameter, for example, and is motor driven to rotate at a speed of 3,000 revolutions per minute or more. A piece of stock material, typically wood, may be cut by moving it across the table to intersect the spinning saw blade. The height of the top of the saw blade above the table may be adjustable within predetermined limits in order to accommodate stock material of various thicknesses.

A fence is provided with a table saw to guide the movement of the stock in a direction parallel to the plane of the saw blade in order to ensure a straight cut and to avoid binding of the non-cutting portions of the saw blade within the stock material. A fence typically includes an elongated metal bar having a flat guide face oriented at a right angle with respect to the table and parallel to the plane of the saw blade. The distance between the fence guide face and the saw blade may be adjustable within predetermined limits in order to accommodate stock material and cut locations having various widths.

It is known to use a push stick to urge the stock material past the saw blade in order to keep the operators' fingers at a safe distance from the dangerous rotating blade. The simplest push stick may be simply an elongated piece of excess stock material that is urged against the work piece. A more sophisticated push stick is described in U.S. Pat. No. 6,135,521 as including an ergonomically designed handle, two stepped portions for engagement with the work piece, and non-slip pads for better control. While the push stick of the '521 patent does provide a degree of protection for the one hand of the operator, it still requires the operator to touch the work piece with a second unprotected hand. Furthermore, this style of push stick can apply downward force against only the trailing edge portion of the work piece since it engages the rear edge of the work piece with a stepped portion of the stick. Applying downward force only against the trailing edge portion of the work piece may be inadequate to hold the stock material down. A long piece of stock material being urged into a saw blade with such a tool may be lifted away from the table by the lifting action of the rotating saw blade, thus creating a dangerous kick-back condition where the work piece is thrown upward toward the table saw operator.

U.S. Pat. No. 2,839,100 describes a woodworking accessory that engages the work piece along an extended length in order to keep the operator's hands away from the saw blade at all times. This device engages the stock material with a plurality of screws, thus causing undesirable damage to the work piece. While this device provides improved control of the work piece between the saw blade and the fence guide face, it does not provide any control for the severed portion of the work piece on the far side of the blade away from the fence, commonly called the outside cut material. While the outside cut material is often considered the scrap portion of the stock material, it nonetheless may present a danger to the operator if it is not properly restrained during the cutting operation.

U.S. Pat. No. 4,370,909 describes a hand guard for a table saw including a grooved underside adapted to rest on top of the work piece and a vertically moveable heel for engaging the rear edge of the work piece. Here, again, this tool engages the stock material only near its rear edge and is thus ineffective in restraining the leading edge portion of a long piece of stock material. Furthermore, the tool is narrow and must be positioned against the guide fence, so it is useful for removing only a small width of material from the work piece. The tool is designed to exert a pushing force against the work piece. It includes no means for positively forcing the work piece against the guide fence, thus necessitating the use of the operator's second unprotected hand for maintaining pressure against the fence as the work piece is moved past the saw blade.

BRIEF DESCRIPTION OF THE DRAWINGS

The invention is explained in the following description in view of the drawings that show.

DETAILED DESCRIPTION OF THE INVENTION

The present inventor has devised a unique and innovative tunneled push block and guide system. The tunnels are configured to straddle a saw blade during a cutting operation. This safely and securely holds the workpiece on both sides of the saw blade at a location close to the saw blade during and after the cutting operation. Each tunnel is suitable for straddling the saw blade in two respective ranges of fence positions. A first range of fence positions applies the push block in a first position, and a second range of fence positions applies when the push block is flipped around to a second position. This allows the push block to straddle the saw blade when the fence is in any position within any of the applicable ranges of fence positions without being cut by the saw blade during the cutting operation. This, in turn, enable use of the push block without cutting/sacrificing the push block. In an example embodiment, the individual ranges of fence positions together form a continuous range of fence positions.

Many table saws have a guide/ruler and a position indicator that moves along the ruler proportionally as the fence moves. The position indicator indicates on the ruler an actual distance of the fence from the inside/near edge of the saw blade, in other word, it indicates the position of the inside edge of the saw blade. The guide system disclosed herein includes a respective ruler indicator that is associated with a respective range of fence positions. The respective ruler indicator identifies the respective range of positions on the ruler that correlates with a range of a respective tunnel. When the position indicator is located within a respective ruler indicator on the ruler, the saw blade will fit in the respective tunnel associated with the respective ruler indicator.

The guide system optionally includes respective corresponding push block identifiers on the push block. The respective corresponding push block identifiers may be positioned on the push block to identify which tunnel and which position of the push block is associated with the respective ruler indicator on the ruler. In this way, for a given position of the position indicator on the ruler, the user can know which push block position and tunnel is appropriate.

Figure 1:
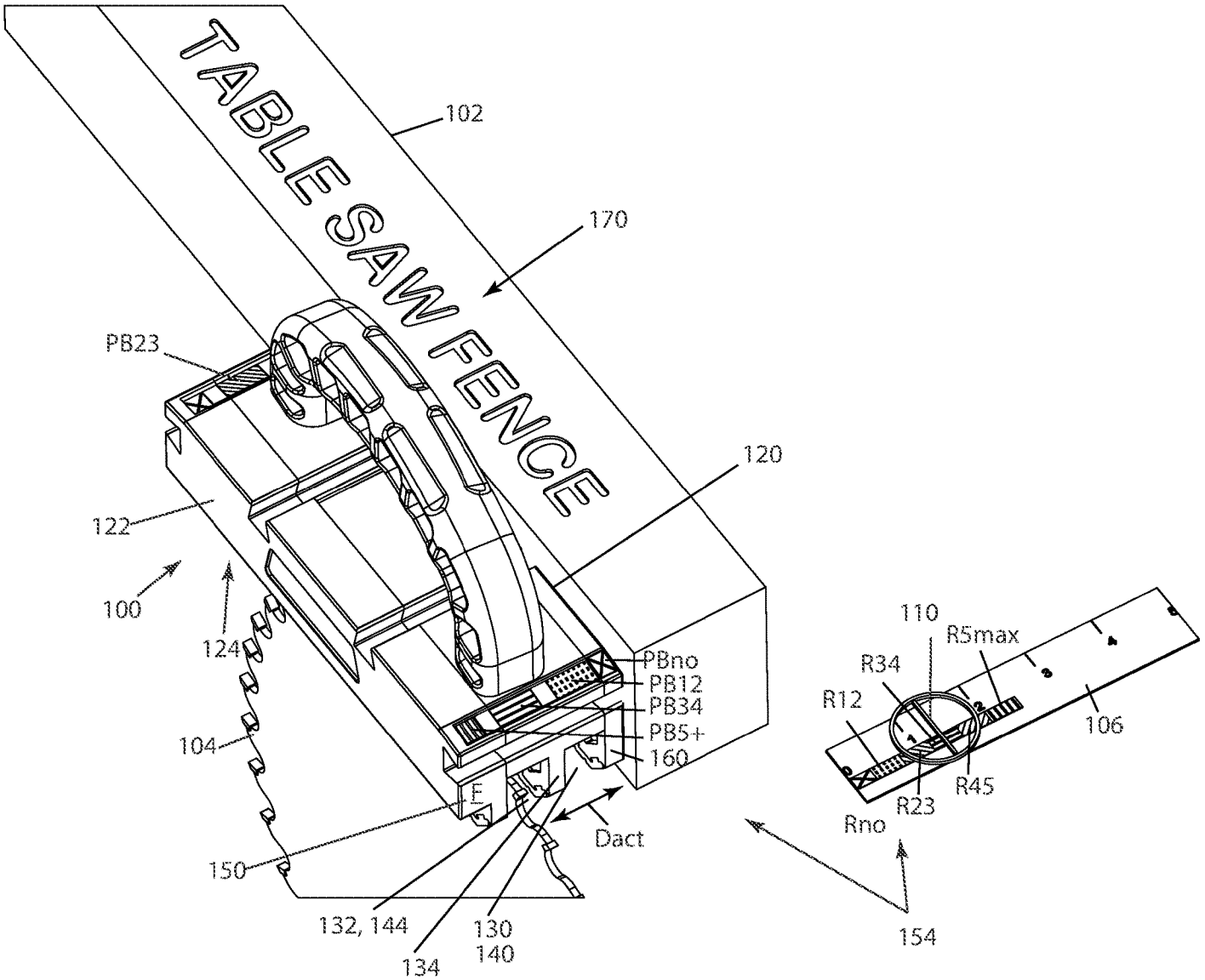
FIG. 1 is a perspective view of an example embodiment of a tunneled push block with an example embodiment of a guide system.
Figure 2:
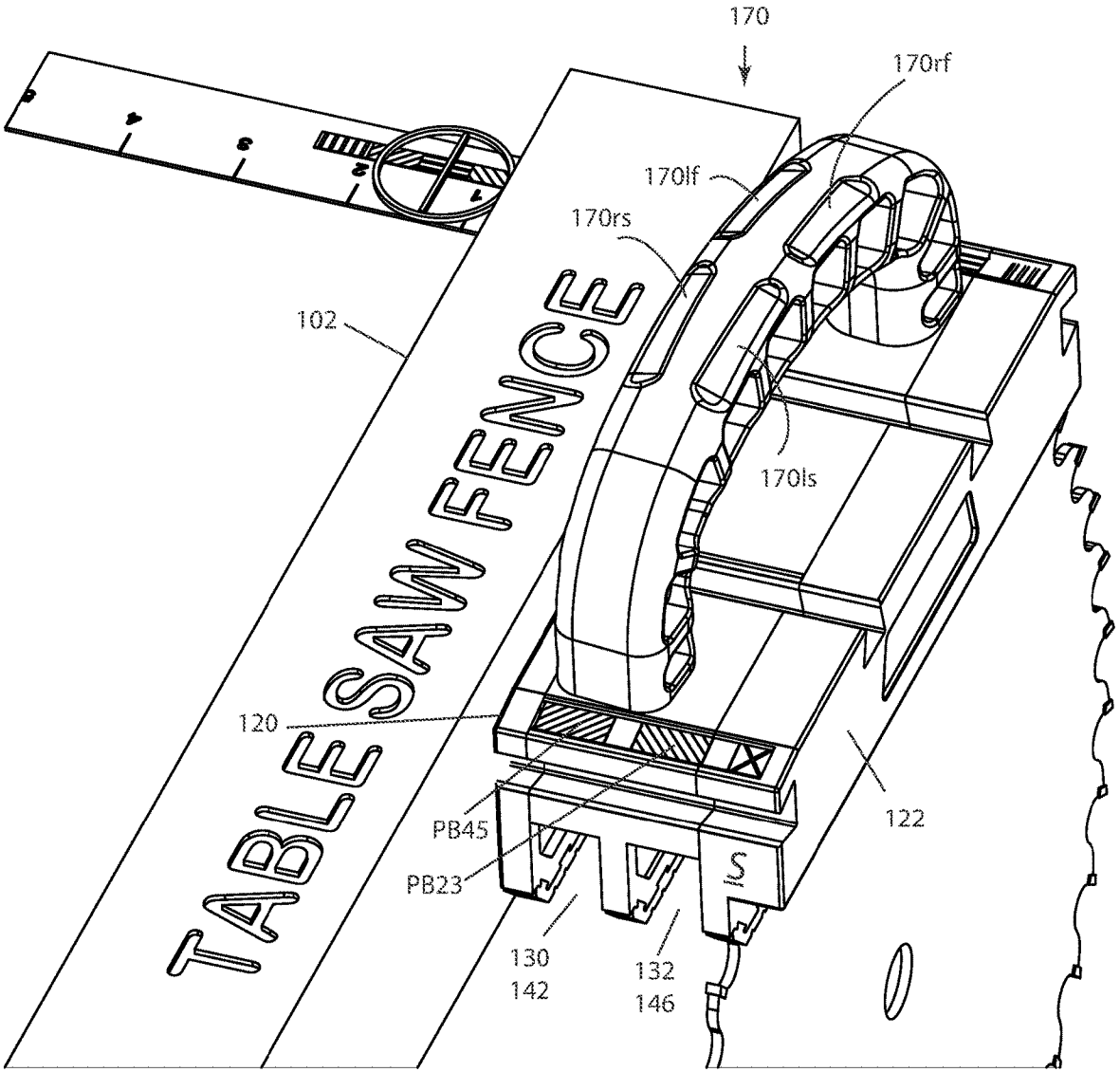
FIG. 2 is another perspective view of the tunneled push block and guide system of FIG. 1.

FIG. 1 and FIG. 2 are perspective views of an example embodiment of a tunneled push block 100 with an example embodiment of a guide system. The tunneled push block 100 is configured to abut a table saw fence 102 and guide a workpiece over a saw blade 104. A ruler 106 on the table saw indicates distances between the fence 102 and an inside/nearest side 108 of the saw blade 104. An indicator 110 moves along the ruler 106 as the fence 102 is moved and the indicator 110 indicates an actual position of the saw blade 104 by showing the distance Dact of the inside side 108 relative to the fence 102.

The push block 100 includes: a first side 120 and a second side 122, each configured to abut and slide along the fence 102; and a bottom 124 having a first tunnel 130, a second tunnel 132, and an immovable dividing wall 134 therebetween.

As shown in FIG. 1, a push block first end F faces an operator when the first side 120 abuts the fence 102. As seen in FIG. 2, a push block second end F faces away from the operator when the first side 120 abuts the fence 102. The first tunnel 130 includes a first tunnel first end 140 associated with the push block first end F, a first tunnel second end 142 associated with the push block second end S, and the second tunnel 132 includes a second tunnel first end 144 associated with the push block first end F and a second tunnel second end 146 associated with the push block second end S. The push block 100 also includes a spacer 150 at the second side 122 configured to change the position of the tunnels relative to the fence 102 when the push block 100 is positioned so that the second side 122 abuts the fence 102 as compared to when the first side 120 abuts the fence 102.

Figure 3:
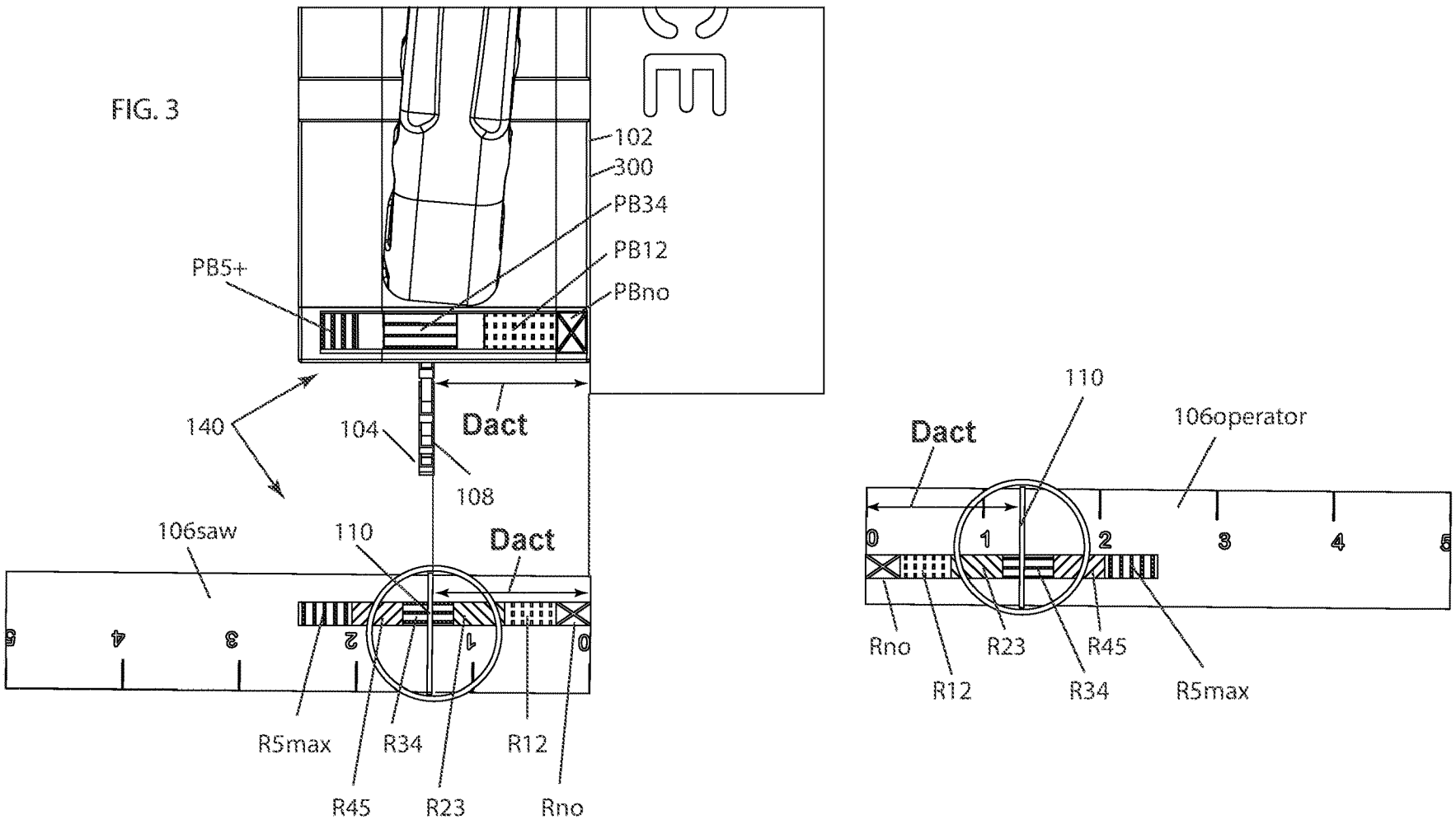
FIG. 3 is a top view of the tunneled push block and guide system of FIG. 1.

The guide system includes ruler indicators Rno, R12, R23, R34, R45, and R5max that indicate ranges on the ruler 106. (See also FIG. 3 and FIG. 4 as related to the following disclosure.) Rno indicates a range of positions in which no cut should be made. R12 indicates a range of fence positions associated with the first tunnel 130 when the first side 120 abuts the fence 102 (as shown in FIG. 3). R23 indicates a range of fence positions associated with the second tunnel 132 when the second side 122 abuts the fence 102. R34 indicates a range of fence positions associated with the second tunnel 132 when the first side 120 abuts the fence 102. R45 indicates a range of fence positions associated with the first tunnel 130 when the second side 122 abuts the fence 102. R5max indicates a range of fence positions associated with the spacer 150 when the first side 120 abuts the fence 102 (as shown in FIG. 3).

If the indicator 110 is within indicator Rno on the ruler 106, then no cut should be made. If the indicator 110 is within indicator R12 on the ruler 106, then the saw blade 104 will fit within the first tunnel 130 when the first side 120 of the push block 100 abuts the fence 102. If the indicator 110 is within indicator R23, then the saw blade 104 will fit within the second tunnel 132 when the second side 122 of the push block 100 abuts the fence 102 If the indicator 110 is within indicator R34, then the saw blade 104 will fit within the second tunnel 132 when the first side 120 of the push block 100 abuts the fence 102. If the indicator 110 is within indicator R45, then the saw blade 104 will fit within the first tunnel 130 when the second side 122 of the push block 100 abuts the fence 102. If the indicator 110 is within indicator R5max, then the saw blade 104 will be under the spacer 150. If the indicator is past indicator R5max, then the saw blade 104 is out from under the push block 100 when either the first side 120 or the second side 122 abut the fence 102.

The guide system 154 may further include push block indicators PBno, PB12, PB23, PB34, PB45, PB5max disposed on the push block. The push block indicators may indicate which tunnel 130, 132 and push block position are associated with a respective ruler indicator. The push block 100 is in a first position when the first side 120 abuts the fence 102 (FIG. 1) and a second position when the second side 122 abuts the fence 102.

In the first position the first end F faces the operator, a first leg 160 of the pushblock 100 occupies positions associated with ruler indicator Rno, the first tunnel 130 encompasses positions associated with ruler indicator R12, the second tunnel encompasses positions associated with ruler indicator R34, and the spacer 150 is disposed above positions associated with ruler indicator R5max. Consequently, push block indicator PBno is positioned above the first leg 160, push block indicator PB12 is positioned above the first tunnel 130, push block indicator PB34 is positioned above the second tunnel 132, and pushblock indicator PB5max is positioned above the spacer at the first end F.

Similarly, in the second position the second end S faces the operator, the second tunnel 132 encompasses positions associated with ruler indicator R23 and the first tunnel encompasses positions associated with ruler indicator R45. Consequently, push block indicator PB23 is positioned above the second tunnel 132 and push block indicator PB45 is positioned above the first tunnel 130 at the second end S.

The ruler indicators Rno, R12, R23, R34, R45, and R5max may be any type of indicator known to the artisan that can be distinguished from each other. For example, the ruler indicators may be different colors, or different hatchings, shadings, designs, symbols, words, physical textures/shapes etc. Likewise, the push block indicators PBno, PB12, PB23, PB34, PB45, PB5max may be any type of indicator known to the artisan that can be distinguished from each other. In an example embodiment, the ruler indicators Rno, R12, R23, R34, R45, and R5max respectively correspond to the block indicators PBno, PB12, PB23, PB34, PB45, PB5max. For example, the feature associated with ruler indicator Rno, (e.g., a select color) may match or be the same as the feature associated with block indicator PBno (e.g., the select color). As is disclosed herein, the ruler indicator Rno and the block indicator PBno are both "x" shapes. In various embodiments, the colors of ruler indicators R12, R23, R34, R45, and R5max may be different from each other and the same as the colors of respective block indicators PB12, PB23, PB34, PB45, PB5max. For example, both ruler indicator R12 and block indicator PB12 may be green. In an example, both ruler indicator R23 and block indicator PB23 may be orange. In an example, both ruler indicator R34 and block indicator PB34 may be yellow. In an example, both ruler indicator R45 and block indicator PB45 may be blue. In an example, both ruler indicator R5max and block indicator PB5max may be striped (e.g., a colored stripe such as purple on a white background or the reverse).

The push block 100 further includes a thumb guide arrangement 170 that includes four thumb guides 170*rf*, 170*rr*, 1701*f*, 1701*r* disposed on a handle 172. The thumb guide arrangement 170 is disclosed in FIG. 7.

FIG. 3 is a top view of the tunneled push block 100 and guide system 154. The ruler 106 is shown twice and indicates an example actual position of the saw blade 104. The ruler 106 operator shows the ruler as seen by an operator of the table saw. The ruler 106 saw shows the measurement the ruler is taking on the table saw between an inside edge 300 of the fence 102 and the actual position of the near side 108 of the saw blade 104. In this example, the near side 108 of the saw blade 104 is positioned approximately 1⅜" from the inside edge 300 of the fence 102. This position/distance is reflected in that the indicator 110 is positioned at the 1⅜" position on the rulers. This position falls within ruler indicator R34. Ruler indicator R34 corresponds to push block indicator PB34. Consequently, the saw blade 104 fits in the tunnel indicated by push block indicator PB34 when PB34 faces the operator. In this example, this is the second tunnel 132 when the push block 100 is in the first position (in which the first side 120 abuts the fence 102).

Figure 4:
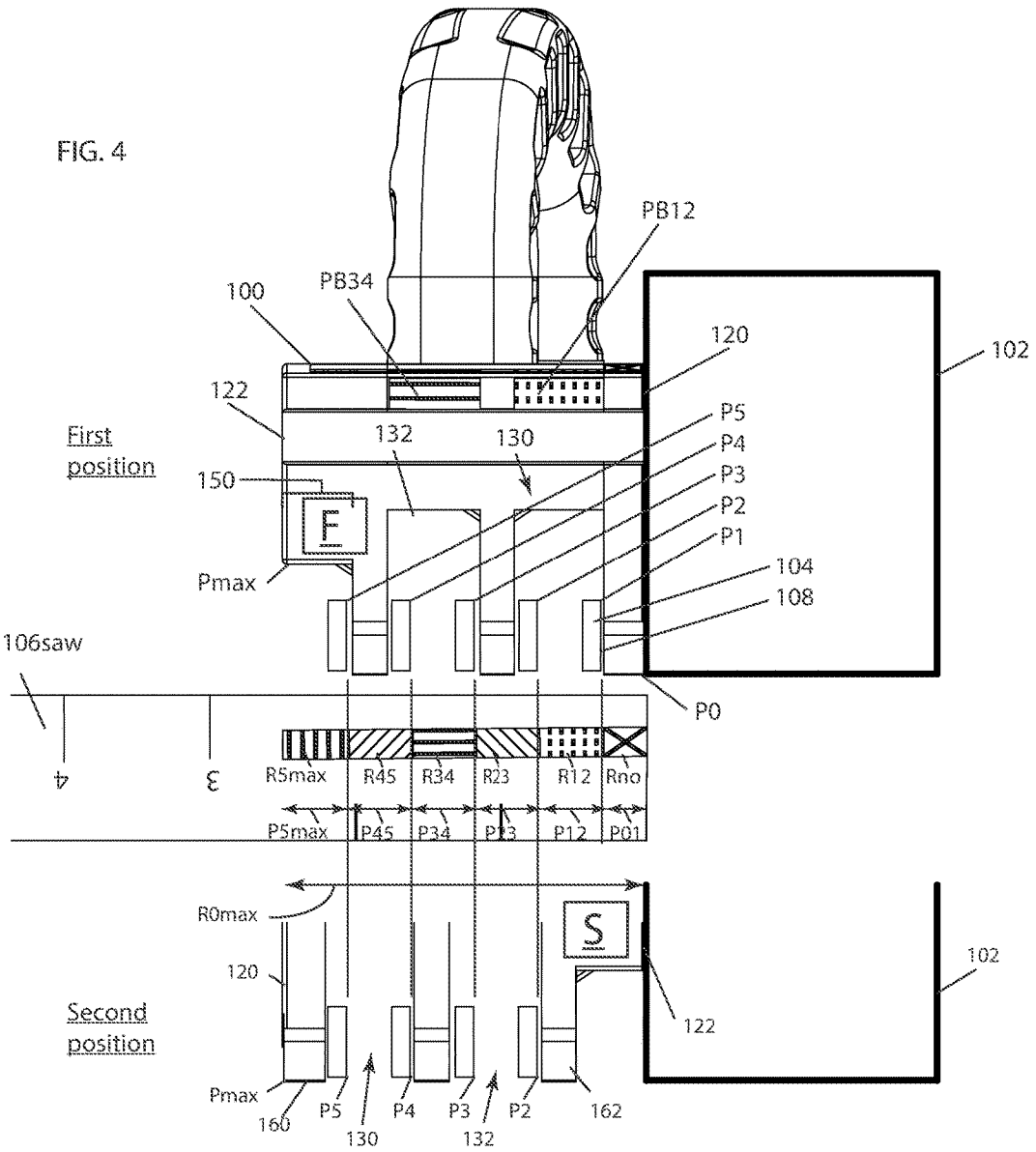
FIG. 4 illustrates the function of the tunneled push block and guide system of FIG. 1.

FIG. 4 illustrates the function of the tunneled push block 100 and guide system 154 of FIG. 1. In FIG. 4, the push block 100 is shown in the first position, against the fence 102, and above the same push block 100 which is also shown in the second position and also against the same fence 102. The ruler 106 saw is also shown with the ruler indicators. Inside each tunnel 130, 132 in the first position and each tunnel 130, 132 in the second position are two rectangles. Each rectangle represents the saw blade 104 at each end of the range of positions associated with the tunnel 130, 132 in the respective position.

Ruler indicator Rno indicates a range of positions P01 in which no cut should be made.

When the push block 100 is in the first position, the near side 108 of the saw blade 104 can move in the first tunnel 130 within a range starting at position P1 and ending at position P2. Positions P1 and P2 therefore define the ends of ruler indicator R12 and associated ends of an associated first tunnel first range of positions P12. When the push block 100 is turned around into the second position where the second side 122 abuts the fence 102, the near side 108 of the saw blade 104 can move inside the second tunnel 132 within a range starting at position P2 and ending at position P3. Positions P2 and P3 therefore define the ends of ruler indicator R23 and associated ends of an associated second tunnel second range of positions P23.

In this example embodiment, the saw blade 104 can be in position P2 in the first tunnel 130 when the push block 100 is in the first position and also in position P2 when in the second tunnel 132 and when the push block 100 is in the second position. Because of this, indicators R12 and R23 abut each other in an end-to-end arrangement.

If the push block 100 is returned to the first position, the near side 108 of the saw blade 104 can move inside the second tunnel 132 within a range starting at position P3 and ending at position P4. Positions P3 and P4 therefore define the ends of ruler indicator R34 and associated ends of an associated second tunnel first range of positions P34. Here again, the saw blade 104 can be in position P3 in the second tunnel 132 when the push block 100 is in the second position and also in position P3 in the second tunnel 132 when the push block is in the first position. Because of this, indicators R23 and R34 abut each other in an end-to-end arrangement.

If the push block 100 is returned to the second position, the near side 108 of the saw blade 104 can move inside the first tunnel 130 within a range starting at position P4 and ending at position P5. Positions P4 and P5 therefore define the ends of ruler indicator R45 and associated ends of an associated first tunnel second range of positions P45. Here again, the saw blade 104 can be in position P4 in the second tunnel 132 when the push block 100 is in the first position and also in position P4 in the first tunnel 130 when the push block is in the second position. Because of this, indicators R34 and R45 abut each other in an end-to-end arrangement.

If the push block 100 is returned to the first position, the near side 108 of the saw blade 104 can move under the spacer 150 within a range starting at position P5 and extending to Pmax at the second side 122. However, the push block 100 may still be used when the saw blade 104 is not under the push block 100. Positions P5 and Pmax therefore define the ends of ruler indicator R5max and associated ends of an associated spacer range of positions P5max. Here again, the saw blade 104 can be in position P5 in the first tunnel 130 when the push block 100 is in the second position and also in position P5 under the spacer 150 when the push block is in the first position. Because of this, indicators R45 and R5max abut each other in an end-to-end arrangement.

Using the ruler 106, a user can set a particular position/distance for a desired cut, observe which ruler indicator is associated with the particular position, find the pushblock indicator associated with the ruler indicator, and position the push block 100 against the fence 102 with the associated push block indicator facing the user. The user can then make the cut and the saw blade 104 should be positioned safely within the tunnel associated with the push block indicator.

In the above example embodiment, the ranges of positions together define a continuous total range of fence positions R0max that is a sum of the individual ranges P01, P12, P23, P34, P45, P5max abutting each other in end-to-end relationships as can be seen by the ruler indicators. In this example embodiment, the individual ranges are therefore different/discrete/unique from each other. However, one or more of the individual ranges can overlap each other, or there may be one or more gaps between individual ranges.

It can also be understood that any and/or all the positions P1-P5 and Pmax can be adjusted and the adjustment to a select position can be independent of any adjustments to any other position. For example, the width of the spacer 150 and the locations and widths of the first leg 160, the dividing wall 134, and/or a second leg 162 can be adjusted as necessary to achieve the desired positions P1-P5 and Pmax.

In addition, there may be any number of separating walls and any number of associated positions and associated ranges.

Figure 5:
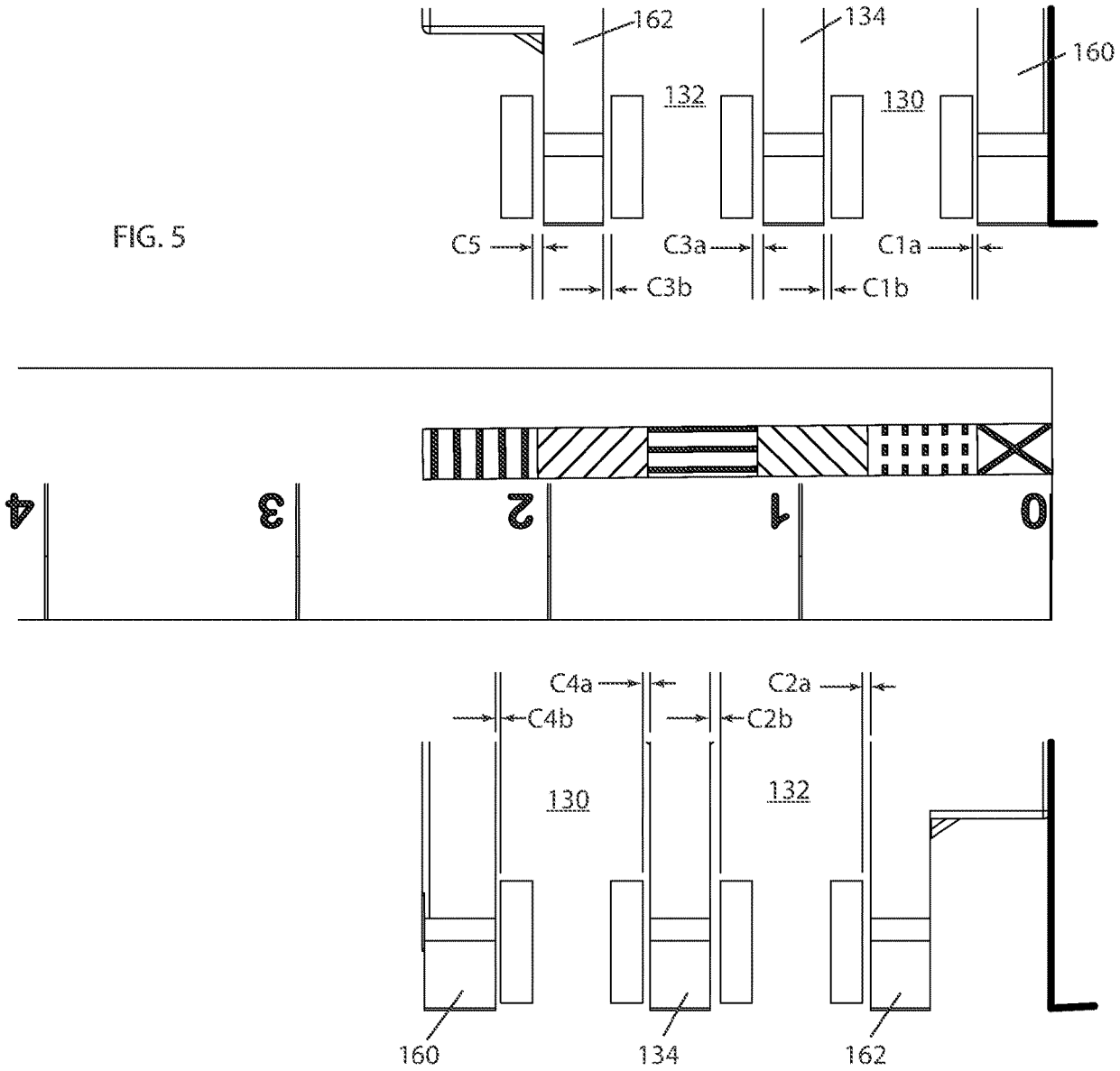
FIG. 5 illustrates an example embodiment of clearances of the tunneled push block of FIG. 1.

FIG. 5 shows the illustrates an example embodiment of clearances of the tunneled push block of FIG. 1. The tunnels are defined by the first leg 160, a second leg 162, and the dividing wall 134 therebetween. Although not labeled for sake of clarity, the rectangles/saw blade in FIG. 5 may be deemed to be in the same positions P1-P5 shown in FIG. 4. Various clearances C1*a*, C1*b*, C2*a*, C2*b*, C3*a*, C3*b*, c4*a*, C4*b*, C5 between the saw blade 104 and the first leg 160, the second leg 162, and the dividing wall 134 are built into the design. This helps avoid damage due to slight improper positioning of the push block 100 and/or variations in the table saw from design/ideal. Certain clearances C1*b*, C2*b*, C3*b*, C4*b* would also allow for a slightly thicker saw blade.

It can also be understood that the first leg 160 can be made thinner or thicker, which could increase or decrease clearances C1*a*, C4*b* respectively. Likewise, the thickness of the dividing wall 134 can adjusted to adjust the associated clearances C1*b*, C3*a*, C2*b*, C4*a*. The thickness of the second leg 162 can similarly be adjusted to adjust the associated clearances C3*b*, C5, C2*a*.

Figure 6B:
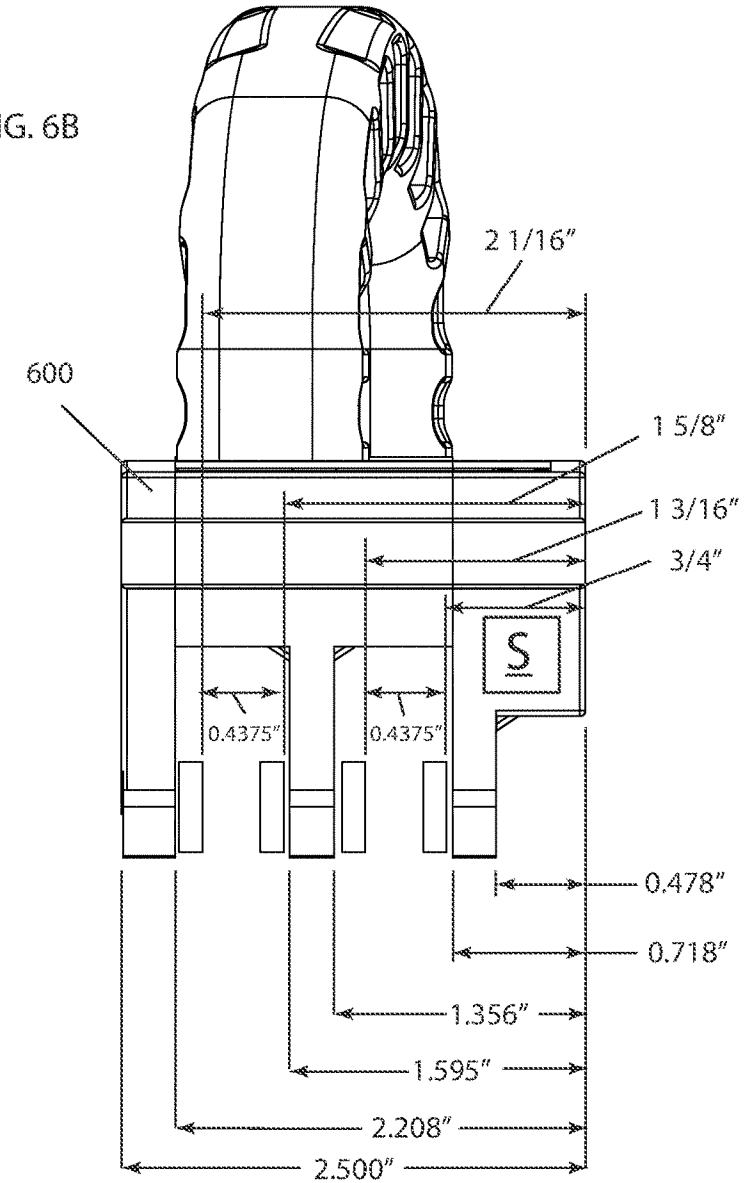
FIG. 6A and FIG. 6B are end views of an example embodiment of the tunneled push block.
Figure 6A:
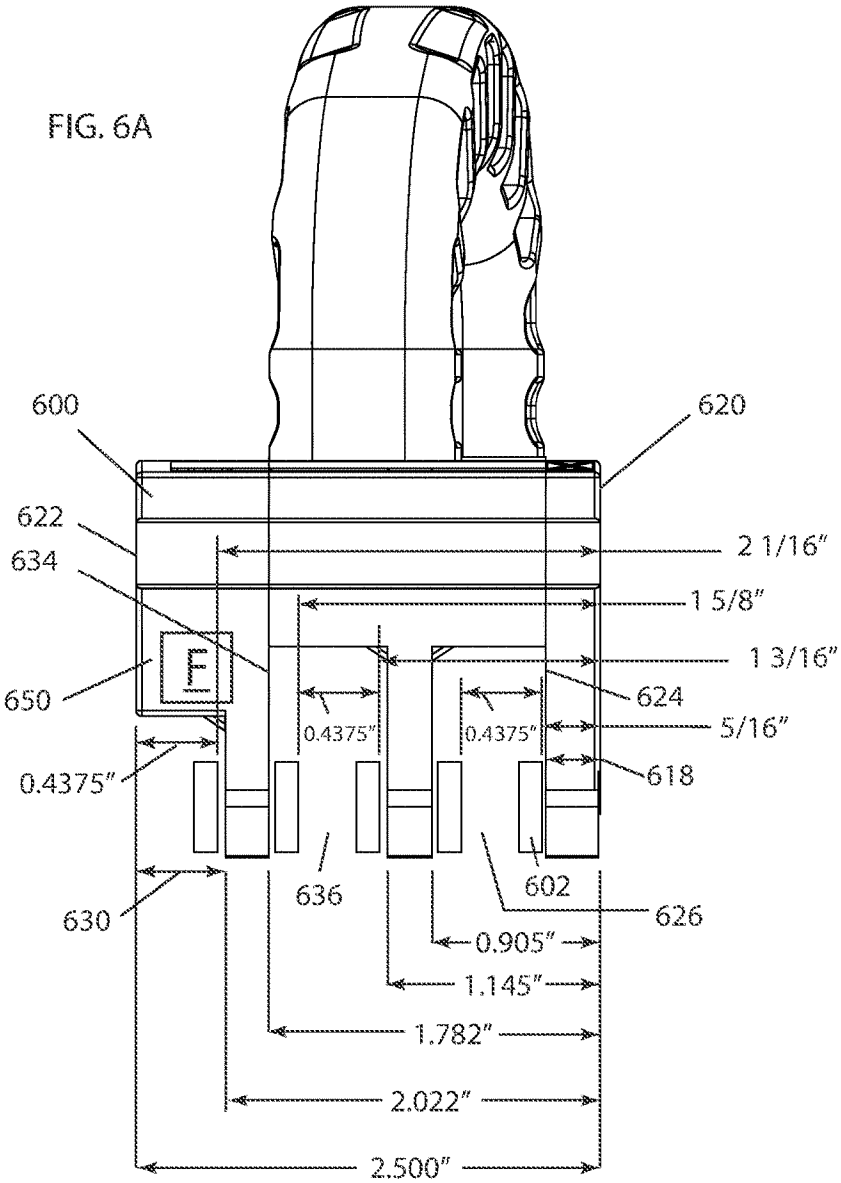

FIG. 6A shows a non-limiting example embodiment of the push block 600 and a saw blade 602 as seen from the first end F and a saw blade 602. FIG. 6B shows the push block 600 and saw blade 602 of FIG. 6A as seen from the second end S.

The push block 600 defines certain distances, such as a first distance 618 between the first side 620 and a nearest wall 624 of the first tunnel 626 and a second distance 630 between the second side 622 and a nearest wall 634 of the second tunnel 636, and wherein the second distance 630 is larger than the first distance 618 due to the presence of the spacer 650. The spacer 650 is sized to coordinate the ranges when the push block 600 is in the second position where the second side 622 is against the fence 102.

FIG. 6A and FIG. 6B disclose example dimensions of a non-limiting example embodiment of the push block 600 with a ⅛" saw blade 602. However, as noted above, these dimensions can be adjusted as desired. Additionally, if the ⅛" saw blade 602 is replaced with a thinner or thicker saw blade using the same push block 600, clearances C1*b*, C2*b*, C3*b*, C4*b* (as seen in FIG. 5) would increase or decrease respectively.

Figure 7:
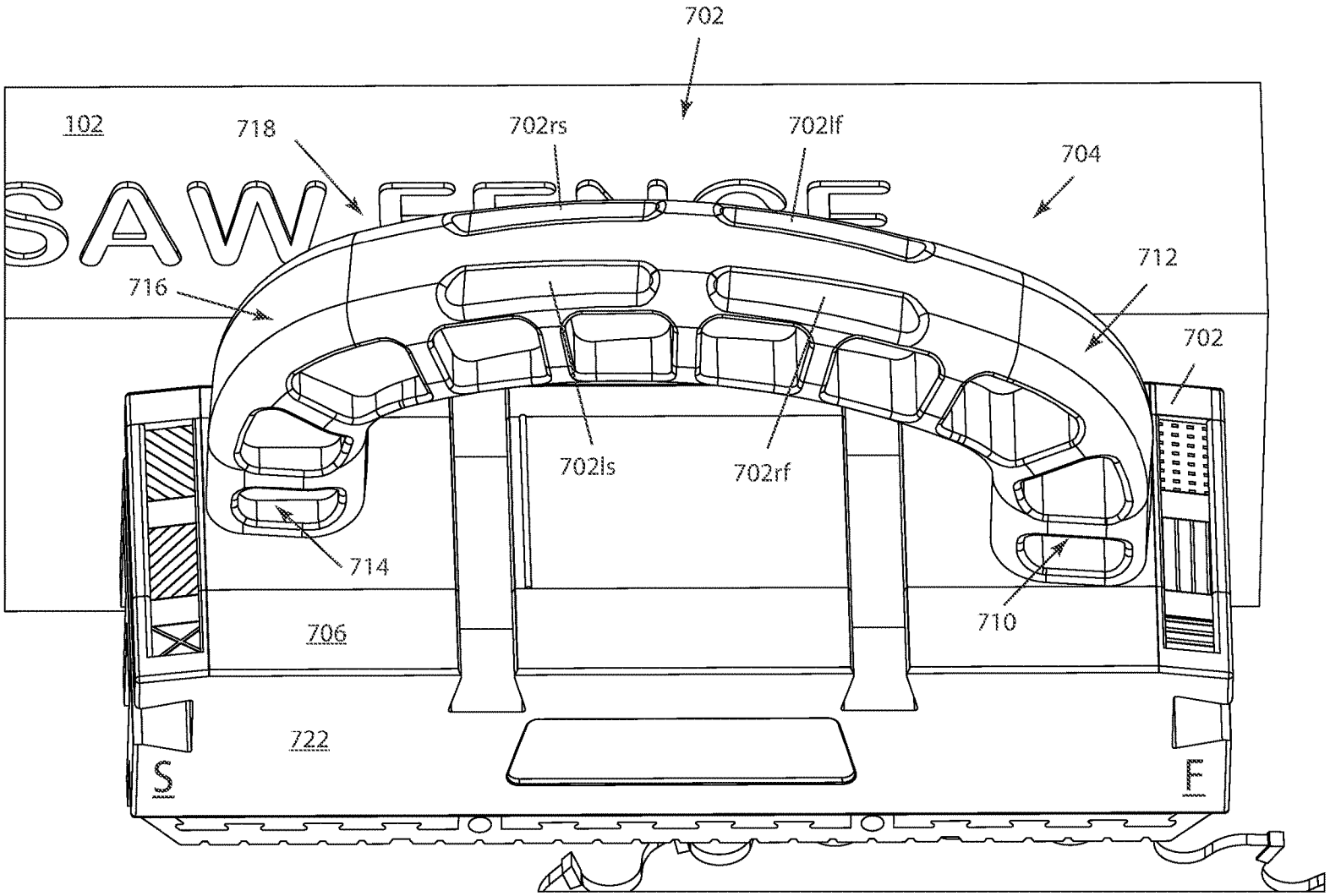
FIG. 7 is a perspective view of the example embodiment of the tunneled push block of FIG. 1 with an example embodiment of a thumb guide arrangement.

FIG. 7 is a side view of the example embodiment of the tunneled push block 700 of FIG. 1 with an example embodiment of a thumb guide arrangement 702 on the handle 704. The handle 704 is secured to a top 706 of the push block 700 and includes a first riser 710 connecting the top 706 to a first bend 712 at the first end F of the push block 700. The handle 704 further includes second riser 714 connecting the top 706 to a second bend 716, and a midspan 718 between the first riser 710 and the second riser 714.

The thumb guide arrangement 702 includes thumb guides 702*rf*, 702*rr*, 7021*f*, 7021*r*. The thumb guides are configured to properly position a user's hand on the handle 704. A proper position of the hand places the user's palm proximate a respective riser 712, 714 so the user pushes the push block 700.

Thumb guide 170*rf* is configured to be a thumb guide on which a right-handed user places a right thumb when the push block 700 is in the first position where the first side 720 abuts the fence 102. When the right thumb is on the thumb guide 170*rf*, the user's palm is positioned at the first riser 712 and this position naturally results in the user pushing the push block 700. Thumb guide 170*lf* is configured to be a thumb guide on which a left-handed user places a left thumb when the push block 700 is in the first position where the first side 720 abuts the fence 102. When the left thumb is on the thumb guide 1701*f*, the user's palm is positioned at the first riser 712 and this position naturally results in the user pushing the push block 700.

Thumb guide 170*rs* is configured to be a thumb guide on which a right-handed user places a right thumb when the push block 700 is in the second position where the second side 722 abuts the fence 102. When the right thumb is on the thumb guide 170*rs*, the user's palm is positioned at the second riser 716 and this position naturally results in the user pushing the push block 700. Thumb guide 170*ls* is configured to be a thumb guide on which a left-handed user places a left thumb when the push block 700 is in the second position where the second side 722 abuts the fence 102. When the left thumb is on the thumb guide 170*ls*, the user's palm is positioned at the second riser 716 and this position naturally results in the user pushing the push block 700.

Figure 8:
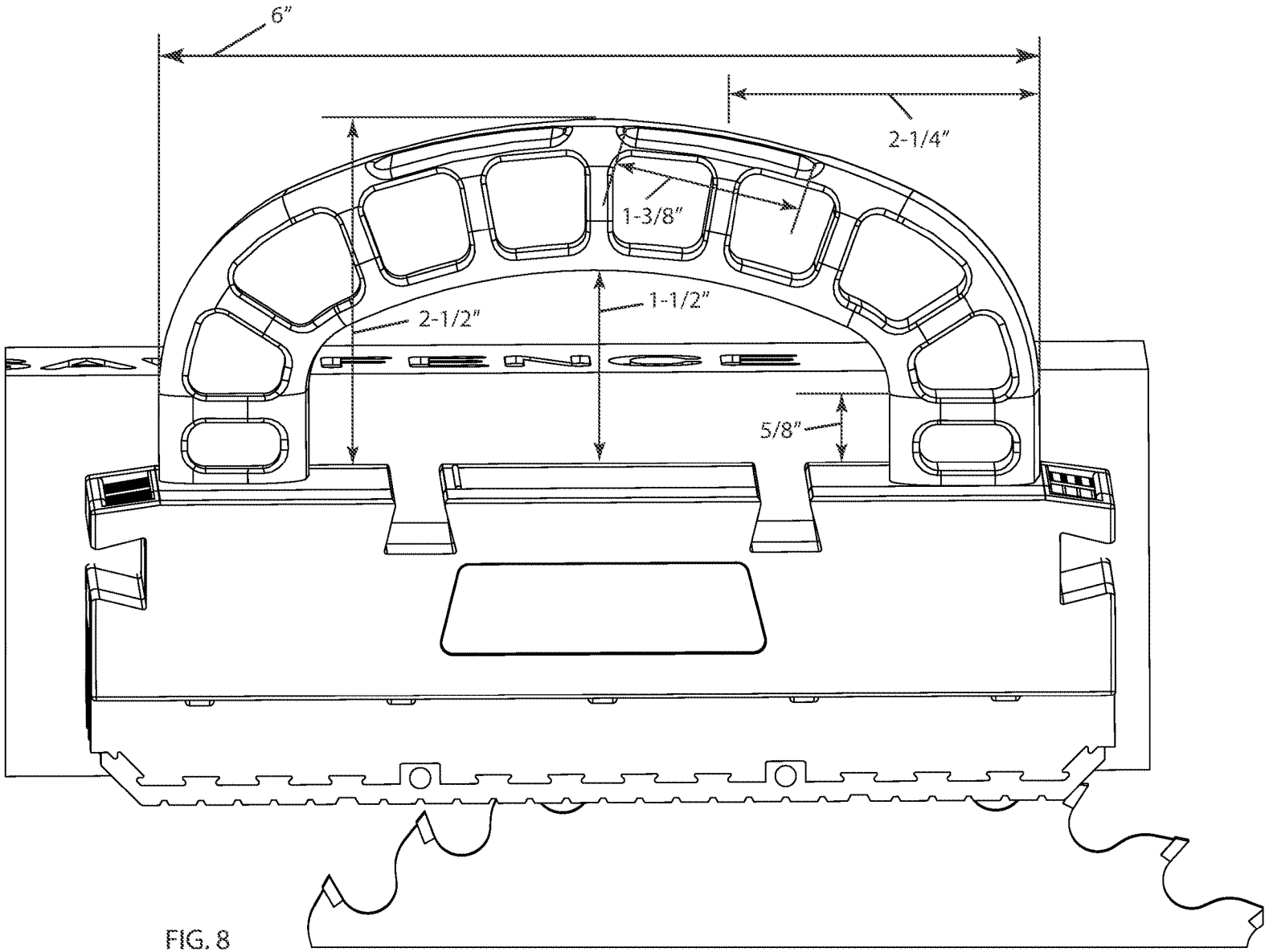
FIG. 8 is a side view of an example embodiment of the tunneled push block and an example embodiment of the thumb block arrangement.

FIG. 8 shows dimensions of a non-limiting example embodiment of the push block 700 and a non-limiting example of the thumb guide arrangement 702. Each dimension represents a middle of a respective range that extends at least ½" in each direction from the middle dimension shown.

The inventor has created a simple, intuitive, and effective push block that allows a user to safely and securely hold a workpiece on both sides of a saw blade while cutting the workpiece and without damaging the push block. The user can do this by simply following the coded indicators and there does not have to do any calculations. This arrangement thereby represents an improvement in the art.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. An apparatus, comprising:

a push block configured to push a workpiece across a table saw, the push block comprising:

a first side and a second side, each configured to abut and slide along a fence of the table saw; and a bottom comprising a first tunnel and a second tunnel and an immovable dividing wall therebetween;

wherein when the first side abuts the fence the first tunnel is configured to straddle a blade throughout a first tunnel first range of fence positions, and the second tunnel is configured to straddle the blade throughout a second tunnel first range of fence positions;

wherein when the second side abuts the fence the first tunnel is configured to straddle the blade throughout a first tunnel second range of fence positions that is different than the first tunnel first range of fence positions, and the second tunnel is configured to straddle the blade throughout a second tunnel second range of fence positions that is different than the second tunnel first range of fence positions.

2. The apparatus of claim 1, wherein the push block defines a first distance between the first side and a nearest wall of the first tunnel and a second distance between the second side and a nearest wall of the second tunnel, and wherein the second distance is larger than the first distance.

3. The apparatus of claim 1, wherein the first tunnel first range of fence positions, the first tunnel second range of fence positions, the second tunnel first range of fence positions, and the second tunnel second range of fence positions are different from each other.

4. The apparatus of claim 1, wherein the first tunnel first range of fence positions, the first tunnel second range of fence positions, the second tunnel first range of fence positions, and the second tunnel second range of fence positions establish a total range of fence positions.

5. The apparatus of claim 4, wherein the total range of fence positions is defined by, in order and end-to-end, the first tunnel first range of fence positions, the second tunnel second range of fence positions, the second tunnel first range of fence positions, and the first tunnel second range of fence positions.

6. The apparatus of claim 1, further comprising a first ruler indicator configured to indicate the first tunnel first range of fence positions on a ruler of the table saw that indicates fence positions.

7. The apparatus of claim 6, wherein the first ruler indicator comprises a color-coded ruler indicator.

8. The apparatus of claim 6, the push block further comprising a first push block indicator that corresponds to the first ruler indicator and that is disposed above an operator-facing end of the first tunnel when first side abuts the fence.

9. The apparatus of claim 8, wherein the first ruler indicator and the first push block indicator each comprise a respective color-coded indicator, and wherein the respective color-coded indicators are the same color.

10. The apparatus of claim 1, further comprising a handle secured to a top of the push block, the handle comprising a u-shape comprising a first riser connecting the top to a first bend that is closer to a user when the first side abuts the fence, a second riser connecting the top to a second bend that is closer to the user when the second side abuts the fence, and a midspan between the first riser and the second riser.

11. The apparatus of claim 10, the handle further comprising a right-hand thumb gauge disposed proximate the first bend and configured to cause a right-hand palm of the user to rest on the first bend when a right-hand thumb is placed on the right-hand thumb gauge when the first side abuts the fence.

12. The apparatus of claim 11, the handle further comprising a left-hand thumb gauge disposed proximate the first bend and configured to cause a left-hand palm of the user to rest on the first bend when a left-hand thumb is placed on the left-hand thumb gauge when the first side abuts the fence.

13. An apparatus, comprising:

a push block configured to push a workpiece across a table saw, the push block comprising:

a first side configured to abut and slide along a fence of the table saw;

a bottom comprising a plurality of non-adjustable tunnels disposed parallel to the side, wherein when the first side abuts the fence each tunnel of the plurality of non-adjustable tunnels is configured to straddle a blade of the table saw throughout a respective first range of fence positions; and a second side opposite the first side and configured to abut and slide along the tence, the second side configured to reposition the plurality of non-adjustable tunnels relative to the fence so that when the second side abuts the fence each tunnel of the plurality of tunnels straddles the blade throughout a respective second range of fence positions that is different than the respective first range of fence positions.

14. The apparatus of claim 13, wherein for each tunnel, the respective first range of fence positions and the respective second range of fence positions are discrete from each other.

15. The apparatus of claim 13, wherein each respective first range of fence positions and each respective second range of fence positions is a unique range within a total range of fence positions.

16. The apparatus of claim 15, wherein each respective first range of fence positions is of a plurality of first ranges of fence positions, wherein each respective second range of fence positions is of a plurality of second ranges of fence positions, and wherein the plurality of first ranges of fence positions and the plurality of second ranges of fence positions alternate within the total range of fence positions.

17. The apparatus of claim 16, wherein first ranges of the plurality of first ranges of fence positions alternate and abut end-to-end with second ranges of the plurality of second ranges alternate.

18. The apparatus of claim 13, further comprising a plurality of ruler indicators, each ruler indicator configured to represent a respective first range of fence positions on a ruler of the table saw that indicates fence positions.

19. The apparatus of claim 18, wherein each ruler indicator comprises a respective colored coded ruler indicator.

20. The apparatus of claim 18, the push block further comprising a plurality of push block indicators, wherein each push block indicator corresponds to a respective ruler indicator, and wherein each push block indicator is disposed proximate a tunnel of the plurality of non-adjustable tunnels that is associated with the respective ruler indicator.

21. The apparatus of claim 13, further comprising a handle secured to a top of the push block, wherein the handle comprises a first right-hand thumb gauge configured to cause a right-hand palm to rest on a user-side end of the handle when a right thumb is placed on the first right-hand thumb gauge and when the first side abuts the fence, wherein when the right-hand palm rests on the user-side end, moving the push block requires a user to push on the handle with the right-hand palm.

22. The apparatus of claim 21, the handle further comprising a first left-hand thumb gauge configured to cause a left-hand palm to rest on the user-side end of the handle when a left-hand thumb is placed on the first left-hand thumb gauge and when the first side abuts the fence, wherein when the left-hand palm rests on the user-side end, moving the push block requires the user to push on the handle with the left-hand palm.

23. The apparatus of claim 22, the handle further comprising:

a second right-hand thumb gauge configured to cause the right-hand palm to rest on the user-side end of the handle when the right thumb is placed on the second right-hand thumb gauge and when the second side abuts the fence; and a second left-hand thumb gauge configured to cause the left-hand palm to rest on the user-side end of the handle when the left-hand thumb is placed on the second left-hand thumb gauge and when the second side abuts the fence.

* * * * *